US006484447B1

(12) United States Patent
Snyder et al.

(10) Patent No.: US 6,484,447 B1
(45) Date of Patent: Nov. 26, 2002

(54) SEAL FOR SECTIONAL DOOR

(75) Inventors: Ronald P. Snyder, Peosta, IA (US); Jason D. Miller, Dubuque, IA (US); Donald P. Grant, Dubuque, IA (US)

(73) Assignee: Rite-Hite Holding Corporation, Milwaukee, WI (US)

( * ) Notice: Subject to any disclaimer, the term of this patent is extended or adjusted under 35 U.S.C. 154(b) by 0 days.

(21) Appl. No.: 09/548,143

(22) Filed: Apr. 13, 2000

(51) Int. Cl.[7] ..... E06B 7/22
(52) U.S. Cl. ..... 49/499.1; 160/40
(58) Field of Search ..... 49/27, 197, 475.1, 49/499.1; 160/40, 201, 232

(56) References Cited

U.S. PATENT DOCUMENTS 3,889,736 A * 6/1975 Firks ..... 160/135
3,941,180 A * 3/1976 Thill ..... 160/232 X
4,676,293 A 6/1987 Hanssen ..... 160/201
5,365,993 A 11/1994 Jellá ..... 160/201
5,566,504 A 10/1996 Pitel ..... 49/28
5,622,012 A * 4/1997 Schijf ..... 160/232 X
5,737,802 A * 4/1998 Jellá ..... 160/201 X
5,832,665 A * 11/1998 Miller et al. ..... 49/27

* cited by examiner

*Primary Examiner*—Jerry Redman
(74) *Attorney, Agent, or Firm*—Marshall, Gerstein & Borun

(57) ABSTRACT

A seal assembly for an overhead-storing door seals the horizontal joints between adjacent panels of the door. The panels are pivotally interconnected at the joints to allow the door to open and close by traveling along a set of lateral tracks that curve between horizontal and vertical. The door closes in the vertical position, and stores horizontally overhead. The seal assembly can also be used for sealing the leading edge of the door panel that closes against the floor. The seal assembly includes a seal holder with a T-shaped anchor that engages a complimental T-shaped seal-receiving opening in a foam core of at least one of the door panels. The seal holder includes shaped grooves for attaching a flexible U-shaped seal member and, if desired, for inserting a reinforcing bar that increases the rigidity of the seal holder. In attaching the seal member to the seal holder, the T-shaped anchor slides in a first direction into the mating seal-receiving opening in the foam core. The sliding fit in a first direction provides a positive connection in another direction perpendicular to the first. This ensures that the seal holder is held firmly in place when in use, yet is readily installed or replaced.

17 Claims, 3 Drawing Sheets

SEAL FOR SECTIONAL DOOR

BACKGROUND OF THE INVENTION

1. Field of the Invention

The subject invention generally pertains to sectional doors and more specifically to a seal for such a door.

2. Description of Related Art

A sectional door typically includes a series of panels that are pivotally interconnected at horizontal joints. As the door opens or closes, the door panels travel along two lateral tracks that, in one configuration, curve between horizontal and vertical. To close the door, the tracks guide the panels to a vertical position, and seals are often disposed between the panels to help close any gaps that may exist along the horizontal joints. When the door opens, the pivotal joints allow the panels to curve around onto the horizontal section of the tracks, where the door panels store horizontally overhead. However, in some cases, the door panels store above the doorway in a generally vertical position or at a slight angle to the wall. Such doors can be powered up or down, or can be manually operated. To ease the operation of the door, a torsion spring is often used to offset the weight of the door panels. Overhead-storing doors are commonly used as a residential garage door; however, they are also often used in warehouses and other industrial buildings.

When used in high-traffic industrial applications, overhead-storing doors are very susceptible to being struck by large trucks, trailers, forklifts and other vehicles passing through the doorway. Sometimes, an upper edge of a vehicle may catch the lowest panel of the door, which often damages that panel. This tends to occur when the door's torsion spring becomes weak with age or is not properly preloaded. A weak or loose spring allows the door to droop or not open fully. Ideally all the panels, but especially the lowest one, have sufficient flexibility and resilience to recover from the impact of a vehicle. Unfortunately, the very features that make a door panel flexible can also make it difficult to firmly attach a seal along the panel's horizontal edges.

For example, some door panels have a lightweight foam core bonded between two tough outer sheets. Such a construction offers great thermal insulation, excellent impact resistance, and minimizes the weight of the panel. Although seals can be firmly anchored to the inside of the two outer sheets, as disclosed in U.S. Pat. No. 4,676,293, it would be easier and simpler to attach the seal directly to the core of the panel if possible. Moreover, in some cases it may be desirable to have a seal that is readily replaceable. However, foam by itself is relatively weak structurally and does not lend itself well to conventional seal anchoring means, such as those disclosed in U.S. Pat. No. 5,365,993. A press fit connection, as shown in FIG. 35 of the '993 patent, or intermittent anchors, such as the screws shown in FIG. 36 of the '993 patent, may be acceptable for a solid wood door; however, such anchoring means might easily release when used on a foam door panel.

SUMMARY OF THE INVENTION

In order to provide a readily replaceable seal for a door panel having a foam core, a door seal assembly includes an extruded seal holder that slidingly engages the foam core. An anchor portion of the seal holder slides in a first direction into a mating seal-receiving opening in the foam. The sliding fit in a first direction provides a positive connection in another direction perpendicular to the first. This ensures that the seal holder is held firmly in place when in use, yet is readily installed or replaced.

In some embodiments, a door seal assembly includes a unitary seal holder that is readily manufactured using a plastic extrusion process.

In some embodiments, the door seal assembly includes a seal that slidingly engages a seal holder.

In some embodiments, a metal bar is attached to the seal holder to increase the rigidity of the seal holder.

In some embodiments the door panel includes a foam core bonded between two face panels.

DESCRIPTION OF THE PREFERRED EMBODIMENT

Figure 1:
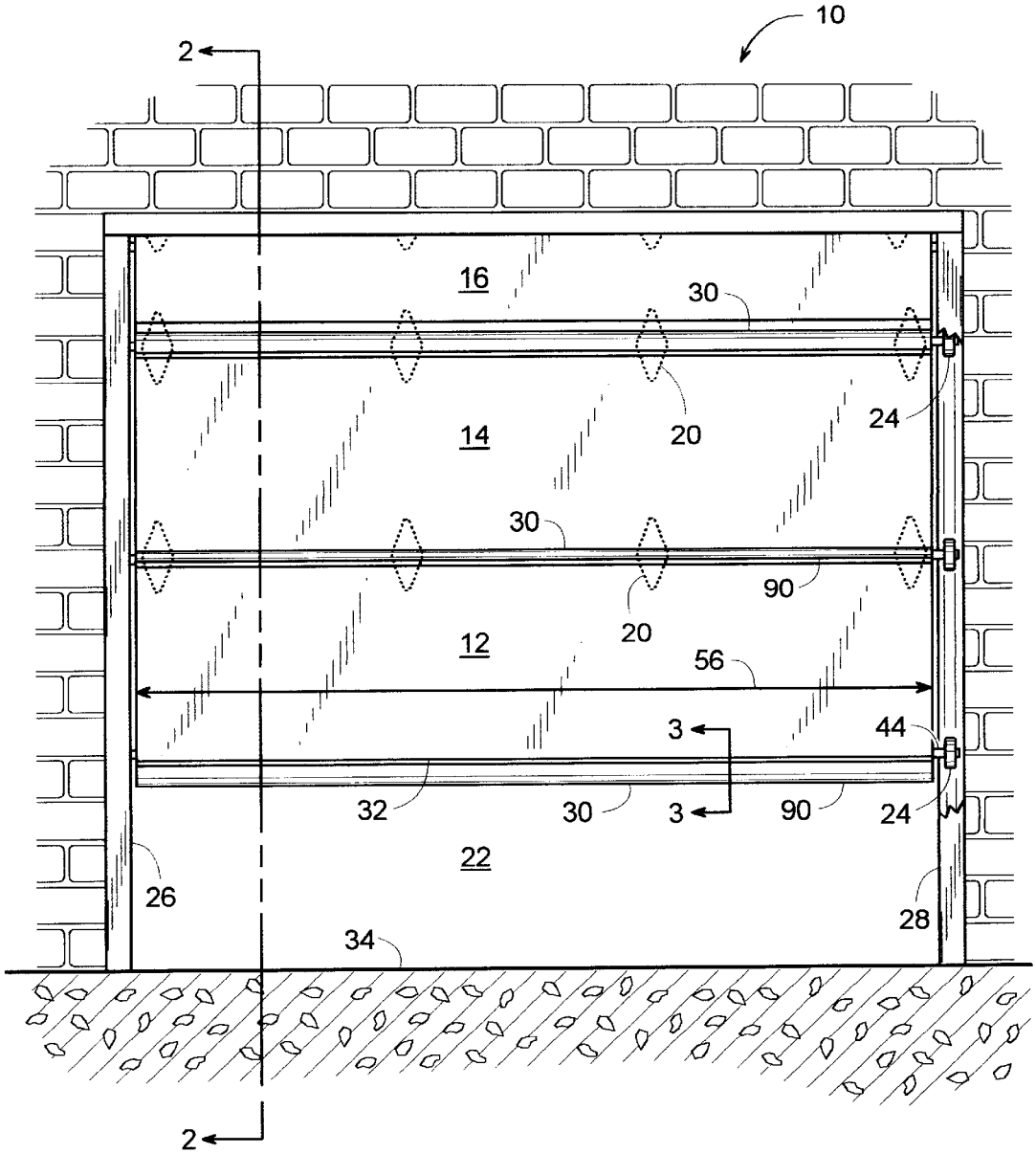
FIG. 1 is a front view of one embodiment of a door seal for an overhead-storing door that is shown partially open.
Figure 2:
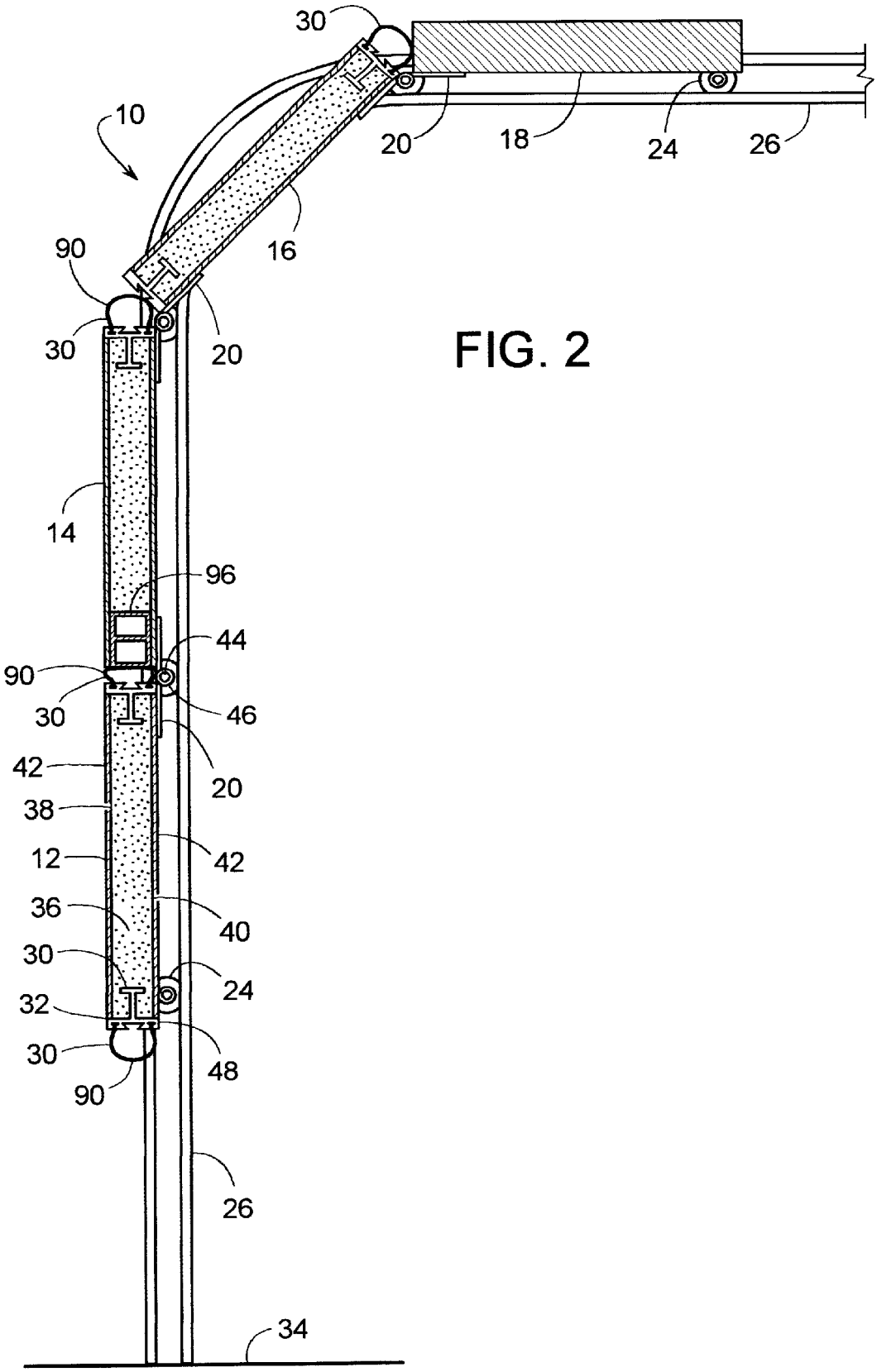
FIG. 2 is a cross-sectional side view taken along line 2—2 of FIG. 1; however, cross-hatching on the seal holders has been omitted for clarity.

A sectional door 10, shown partially open in FIGS. 1 and 2, includes a series of door panels 12, 14, 16 and 18 that are interconnected along horizontal joints by hinges 20. As door 10 opens or closes relative to a doorway 22, guide members, such as rollers 24, guide the movement of the panels along two lateral tracks 26 and 28. In this example, tracks 26 and 28 curve between horizontal and vertical; however, it is well within the scope of the invention to have tracks 26 and 28 run generally linearly or only curve slightly, so that when the door opens, the door panels move above doorway 22, but remain in a generally vertical or slightly angled orientation. To close door 10, the vertical sections of tracks 26 and 28 guide the panels to a vertical position across doorway 22, as indicated by the positions of panels 12 and 14. Door seals 30 attached to the panels help to seal air gaps that would otherwise exist between adjacent panels when the door is fully closed. Also, in this example, the lowermost seal 30 provides a seal between a leading edge 32 of panel 12 and a traffic surface 34 below doorway 22. When door 10 opens, hinges 20 allow the panels to curve around onto the horizontal sections of tracks 26 and 28, where the door panels store horizontally overhead, as indicated by the position of panel 18.

The actual structure of panels 12, 14, 16 and 18 can vary; however, at least the lowermost panel 12 preferably (but not necessarily) has enough flexibility to recover from a vehicle impact, as it is the lowermost panel that is most susceptible to being struck. Thus, in some embodiments, panel 12 comprises a foam core 36 whose outer faces 38 and 40 are each preferably bonded to a tough face panel 42 that is generally harder than foam core 36. Foam core 36 provides a lightweight panel that provides thermal insulation and a desirable balance of rigidity and flexibility, while face panels 42 offer resistance to wear, weather, and impact. Some preferred materials include polyethylene foam for core 36 and an ABS or PVC acrylic for face panels 42; however, a wide variety of other materials could also be used. One or more of the other panels 14, 16 and 18 could be of a similar or completely different construction. For example, any of the other panels, such as panel 18, could be of formed sheet metal or solid wood.

To help allow panel 12 flex in response to an impact, axles 44 of rollers 24 are coupled to panel 12 preferably by way of a horizontal sliding connection 46 that may give or release entirely if panel 12 deflects excessively. In some cases, the sliding connection 46 can be incorporated into hinge 20. However, connection 46 can also be provided independent of the hinges, as is the case with the rollers near the door's leading edge 32.

Figure 3:
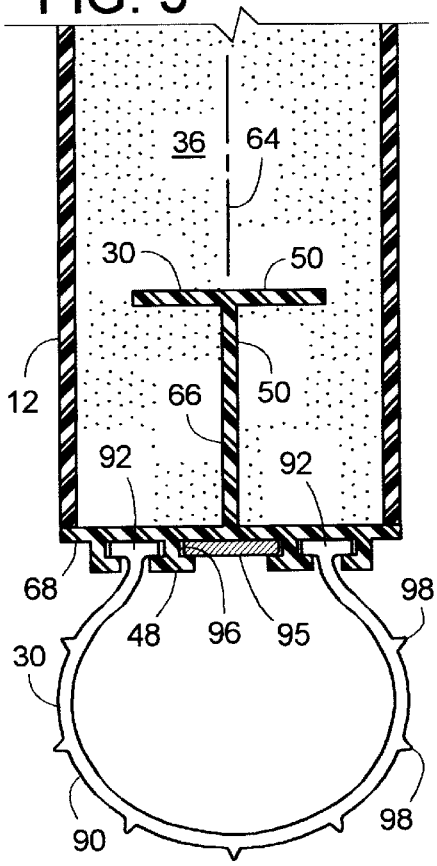
FIG. 3 is a cross-sectional side view taken along line 3—3 of FIG. 1; however, cross-hatching on the seal member has been omitted for clarity.
Figure 4:
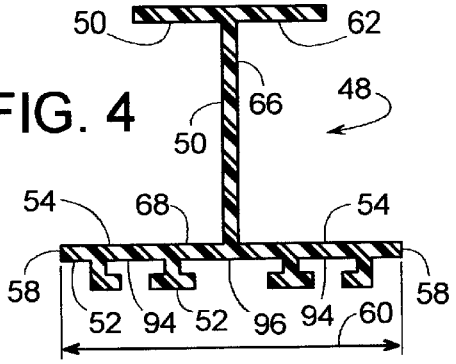
FIG. 4 is a cross-sectional end view of just the seal holder.

To provide a firm, positive connection between an edge seal and a door panel having a foam core, while still maintaining much of the panel's flexibility, door seal 30 includes a seal holder 48 with an anchor 50 that positively engages foam core 36, as shown in FIG. 3. In one embodiment, seal holder 48 includes a base 68 that preferably covers an otherwise exposed edge of core 36. Referring to FIG. 4, base 68 has an outer face 52, an inner face 54, an elongated length 56 (FIG. 1), two edges 58 running along length 56, and a width 60 extending between edges 58. In this example, anchor 50 includes a cross-member 62 that traverses a plane 64. (FIG. 3) along which panel 12 lies, and further traverses a web 66 to generally form a T-shape that can resist pulling out from foam core 36. Base 68, web 66 and cross-member 62 are integrally joined to render seal holder 48 as a unitary piece. Seal holder 48 has a substantially uniform cross-section, which allows holder 48 to be manufactured by way of plastic extrusion. Holder 48 is preferably extruded of polypropylene; however, other materials can also be used.

Figure 5:
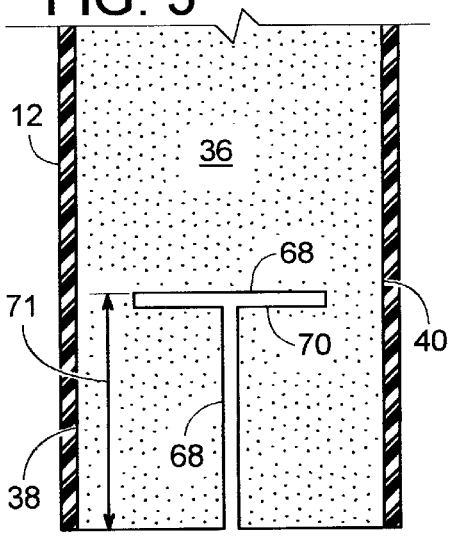
FIG. 5 is a cross-sectional side view of a foam door panel with a seal-receiving opening and two face panels.
Figure 6:
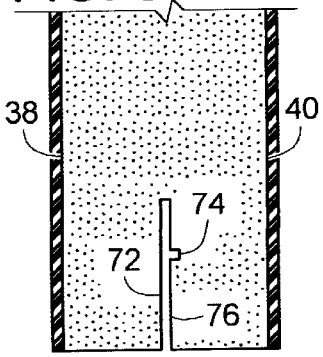
FIG. 6 is a cross-sectional side view of another embodiment of a foam door panel with a seal-receiving opening and two face panels.
Figure 7:
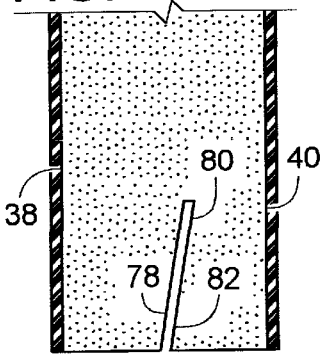
FIG. 7 is a cross-sectional side view of another embodiment of a foam door panel with a seal-receiving opening and two face panels.
Figure 8:
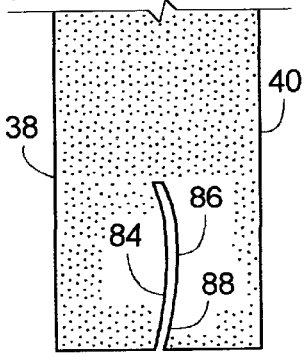
FIG. 8 is a cross-sectional side view of another embodiment of a foam door panel with a seal-receiving opening and two outer faces but without any face panels.

Referring to FIG. 5, to facilitate installing seal holder 48 to panel 12, foam core 36 includes a seal-receiving opening 68, such as a slit having a shape adapted to receive the complimental shape of anchor 50 in a sliding fit relationship. The term, "sliding fit" simply means that one part can be forcibly slid into the other and encompasses fits with clearance as well as those requiring some compression of one or both of the mating parts. To help inhibit anchor 50 from pulling out in a direction perpendicular to the direction that seal holder 48 was installed, preferably a portion 70 of opening 68 extends toward at least one of the two outer surfaces 38 and 40. In other words, the distance from seal-receiving opening 68 to one of the two outer surfaces 38 and 40 varies along a depth 71 of opening 68. This can be accomplished by opening 68 being generally T-shaped, as shown in FIG. 5, or by using a variety of other opening shapes, as illustrated in FIGS. 6–8. For a seal-receiving opening 72 of FIG. 6, outer surface 40 is closer to point 74 at one depth than point 76 at another depth. For an opening 78 of FIG. 7, outer surface 40 is closer to point 80 than point 82. And for an opening 84 of FIG. 8, outer surface 40 is closer to point 86 than point 88. In each of the examples just given, an appropriately shaped seal holder can be slid in a direction parallel to its length to inhibit the seal holder from being pulled out in a direction perpendicular to its length. This can become an especially important feature when foam 36 is of a material that is appreciably softer (i.e., easier to compress) than that of anchor 50.

To install a seal member 90 that can effectively seal the gaps between adjacent edges of the door panels or to seal between leading edge 32 and floor 34, seal member 90 includes two beads 92 along length 56 that slidingly engage mating grooves 94 (FIG. 4) running along outer face 52 of seal holder 48. In some embodiments, seal member 90 is more flexible than seal holder 48 and is preferably extruded of neoprene, but could be made of other flexible materials (including foam) if desired. In this example, seal member 90 is generally U-shaped when attached to seal holder 48. However, the shape of seal member 90 flattens out upon being compressed against floor 34 or being compressed between the edges of two panels. Several ribs 98 running along the length of seal member 90 enhances its sealing ability and may tend to keep seal member 90 centered between the edges against which it is sealing (i.e., ribs 98 may inhibit member 90 from squishing out from between the two edges it is sealing).

To increase the rigidity of seal holder 48, a reinforcing member 95, such as a metal bar, can be slid into a receptacle 96 in base 68, as shown in FIG. 3. Increasing the rigidity of seal holder 48 may be beneficial when used on a single door panel that is especially long, or when used on two shorter panels that are spliced end-to-end to create a long two-piece panel. Installing seal member 90 will cover reinforcing member 95, thus member 95 is shielded from weather and hidden from view.

In some cases, seal holder 48 can be used simply to cover an edge of a foam core panel or to provide a surface against which a separate seal member 90 can seal against, as is the case with a lower edge 32 of panel 16, as shown in FIG. 2. However, there are other ways of covering the edge of a foam core panel, such as the use of an edge member 96 of panel 14.

Although the invention is described with reference to a preferred embodiment, it should be appreciated by those skilled in the art that various modifications and applications are well within the scope of the invention. For example, the door/seal panel assembly can be applied to new door installations or applied as a single replacement panel for an existing door of a completely different style and whose bottom panel is the only one being replaced. Therefore, the scope of the invention is to be determined by reference to the claims that follow.

We claim:

1. A door seal/panel assembly, comprising:

a door panel that includes a foam core between two outer faces, wherein the foam core defines a seal-receiving opening that at one depth is closer to one of the two outer faces than at another depth to create a variable spacing between the seal-receiving opening and one of the two outer faces; and a door seal that includes an anchor having a complemental shape to the seal-receiving opening and being disposed therein, whereby the variable spacing helps hold the door seal in place.

2. The door seal/panel assembly of claim 1, wherein the foam core is softer than the anchor.

3. The door seal/panel assembly of claim 1, wherein the seal-receiving opening has a generally T-shaped cross-section.

4. The door seal/panel assembly of claim 1, wherein the door seal has an elongated length with a substantially uniform cross-sectional shape perpendicular to the elongated length, whereby the door seal is suitable for manufacture by extrusion.

5. The door seal/panel assembly of claim 1, wherein the door seal comprises a seal holder and a seal member with a sliding fit therebetween.

6. The door seal/panel assembly of claim 5, wherein the seal member has a generally U-shaped cross-section.

7. The door seal/panel assembly of claim 1, wherein the door seal defines a receptacle adapted to receive a reinforcing member.

8. The door seal/panel assembly of claim 7, further comprising a metal bar that serves as the reinforcing member, wherein the metal bar is held in the receptacle by way of a sliding fit therebetween.

9. The door seal/panel assembly of claim 1, further comprising two face panels with the foam core being sandwiched therebetween, wherein the two face panels are substantially harder than the foam core.

10. A door seal assembly for a door panel, comprising:

a base having an outer surface, an inner surface, a length, two edges running along the length, and a width extending between the two edges;

an anchor interposed between the two edges, extending outward from the inner surface, and being integrally joined to the inner surface, such that the base and the anchor comprise a unitary seal holder, and where the anchor at one depth is closer to one of the two edges than at another depth; and a seal member attached to the base, protruding outward from the outer surface, and being more flexible than the unitary seal holder, whereby the flexibility of the seal member is suitable for sealing while the anchor of the unitary seal holder is adapted to attach to the door panel, wherein the anchor includes a web and a cross member, wherein the web extends outward from the inner surface of the base and the cross-member lies in a direction that tranverses the web.

11. The door seal assembly of claim 10, wherein the web and the cross-member combined has a generally T-shaped cross-section.

12. The door-seal assembly of claim 10, wherein the seal member has a generally U-shaped cross-section when attached to the base.

13. The door seal of claim 10, wherein the seal member attaches to the base by way of a sliding fit therebetween.

14. The door seal of claim 10, wherein the unitary seal holder defines a receptacle adapted to receive a reinforcing member.

15. The door seal of claim 14, further comprising a metal bar that serves as the reinforcing member, wherein the metal bar is held in the receptacle by way of a sliding fit therebetween.

16. A door seal and panel assembly, comprising:

a door panel that includes a foam core interposed between two face panels, wherein the foam core defines a seal-receiving opening with a portion thereof extending towards at least one of the two face panels;

a base having an outer surface, an inner surface, a length, two edges running along the length, and a width extending between the two edges;

an anchor interposed between the two edges of the base, extending outward from the inner surface of the base, and being integrally joined to the inner surface, such that the base and the anchor comprise a unitary seal holder with the anchor extending into and interlocking with the seal-receiving opening, and where the anchor at one depth is closer to one of the two edges than at another depth; and a seal member attached to the base, protruding outward from the outer surface, and being more flexible than the unitary seal holder, whereby the flexibility of the seal member is suitable for sealing while the anchor of the unitary seal holder is suitable for gripping the foam core.

17. The door seal and panel assembly of claim 16, wherein the seal-receiving opening has a generally T-shaped cross-section.

* * * * *

UNITED STATES PATENT AND TRADEMARK OFFICE

CERTIFICATE OF CORRECTION

PATENT NO. : 6,484,447 B1
DATED : November 16, 2002
INVENTOR(S) : Snyder et al.

It is certified that error appears in the above-identified patent and that said Letters Patent is hereby corrected as shown below:

Column 4,
Lines 49, 60, 62 and 65, please delete “seal/panel” and add -- seal and panel --

Column 5,
Lines 3, 6, 8, 11 and 15, please delete “seal/panel” and add -- seal and panel --
Line 37, please delete “tranverses” and add -- traverses --

Column 6,
Line 1, please delete “door-seal” and add -- door seal --

Signed and Sealed this

Tenth Day of June, 2003

JAMES E. ROGAN
*Director of the United States Patent and Trademark Office*